US011378905B2

(12) United States Patent
Ehara et al.

(10) Patent No.: US 11,378,905 B2
(45) Date of Patent: Jul. 5, 2022

(54) COLOR REGISTRATION BY VARYING ROTATIONAL SPEED OF PHOTOSENSITIVE DRUM

(71) Applicant: Hewlett-Packard Development Company, L.P., Spring, TX (US)

(72) Inventors: Yasuhisa Ehara, Seongnam-si (KR); Jaeil Yu, Seongnam-si (KR); Sangbum Woo, Seongnam-si (KR); Sungdae Kim, Seongnam-si (KR); Sooyong Kim, Seongnam-si (KR); Youngwan Cho, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/281,044

(22) PCT Filed: Oct. 11, 2019

(86) PCT No.: PCT/US2019/055788
§ 371 (c)(1),
(2) Date: Mar. 29, 2021

(87) PCT Pub. No.: WO2020/185258
PCT Pub. Date: Sep. 17, 2020

(65) Prior Publication Data

US 2021/0341863 A1 Nov. 4, 2021

(30) Foreign Application Priority Data

Mar. 11, 2019 (KR) ..... 10-2019-0027646

(51) Int. Cl.
*G03G 15/00* (2006.01)
*G03G 15/01* (2006.01)

(52) U.S. Cl.
CPC ..... *G03G 15/5008* (2013.01); *G03G 15/01* (2013.01); *G03G 15/6561* (2013.01)

(58) Field of Classification Search
CPC ..... G03G 15/5008
See application file for complete search history.

(56) References Cited

U.S. PATENT DOCUMENTS

| | | | |
|---|---|---|---|
| 5,809,380 | A | 9/1998 | Katakabe et al. |
| 8,862,002 | B2 | 10/2014 | Igarashi et al. |
| 9,042,785 | B2 | 5/2015 | Doshida |
| 2009/0297222 | A1 | 12/2009 | Kawamura |

(Continued)

FOREIGN PATENT DOCUMENTS

| | | | |
|---|---|---|---|
| CN | 107608189 | A | 1/2018 |
| JP | 4820733 | B2 | 11/2011 |

(Continued)

*Primary Examiner* — Walter L Lindsay, Jr.
*Assistant Examiner* — Andrew V Do
(74) *Attorney, Agent, or Firm* — Jefferson IP Law, LLP

(57) ABSTRACT

An example image forming apparatus includes a printing engine including a plurality of photosensitive drums, a motor device to provide a driving force to each of the plurality of photosensitive drums, and a processor to control the printing engine such that printing data is printed on a printing paper and control the motor device such that at least one of the plurality of photosensitive drums operates at a different speed from the other photosensitive drums while the printing data is printed.

20 Claims, 12 Drawing Sheets

(56) References Cited

U.S. PATENT DOCUMENTS

| | | | | |
|---|---|---|---|---|
| 2010/0008689 | A1* | 1/2010 | Iwasaki | G03G 15/0194 399/66 |
| 2012/0003010 | A1 | 1/2012 | Birumachi | |

FOREIGN PATENT DOCUMENTS

| | | | |
|---|---|---|---|
| JP | 5006086 | B2 | 8/2012 |
| JP | 5038082 | B2 | 10/2012 |
| JP | 5196299 | B2 | 5/2013 |

* cited by examiner

COLOR REGISTRATION BY VARYING ROTATIONAL SPEED OF PHOTOSENSITIVE DRUM

BACKGROUND

An image forming apparatus refers to an apparatus that performs generation, printing, reception, transmission, etc. of image data. As representative examples of image forming apparatuses, there are printers, scanners, copiers, facsimiles, and multi-function printers that integrally implement the functions of the aforementioned apparatuses, etc.

In order that a color image can be implemented precisely, color registration is performed. Color registration refers to an adjustment of a time point of exposure, etc. so that a plurality of colors that will form an image can be overlapped with a printing paper or a transcription belt precisely.

DETAILED DESCRIPTION

Hereinafter, various examples of the disclosure will be described with reference to the accompanying drawings. The examples described below may be implemented while being modified into several different forms.

A description in this specification that one element is "connected to" another element may be interpreted to include either the case in which the one element is directly connected to the other element, or the case in which the one element is connected to the other element through still another element unless there is a specific description to the contrary. Also, a description in this specification that one element "includes" another element may be interpreted to mean that other elements may additionally be included, but not that other elements are excluded, unless there is a specific description to the contrary.

In the following description, the term "image forming job" may mean any of various kinds of jobs (e.g., printing, copying, scanning, or faxing) related to an image such as formation of an image, generation/storing/transmission of an image file, etc. Also, the term "job" may not only mean an image forming job, but may also mean a series of processes necessary for performing an image forming job.

An "image forming apparatus" refers to an apparatus that prints printing data generated at a terminal apparatus like a computer on a recording medium such as paper. As examples of such an image forming apparatus, there are copiers, printers, scanners, facsimiles, or multi-function printers (MFPs) that multiply implement one or more functions of the aforementioned apparatuses through one apparatus, etc.

Also, "printing data" may mean data converted into a printable format at a printer. If a printer supports direct printing, a file itself may be printing data.

A "user" may mean a person who performs operations related to an image forming job by using an image forming apparatus, or a device connected to an image forming apparatus by a wired or wireless connection. Also, a "manager" may mean a person who has authority to access all functions and the system of an image forming apparatus. A "manager" and a "user" may be the same person.

Figure 1:
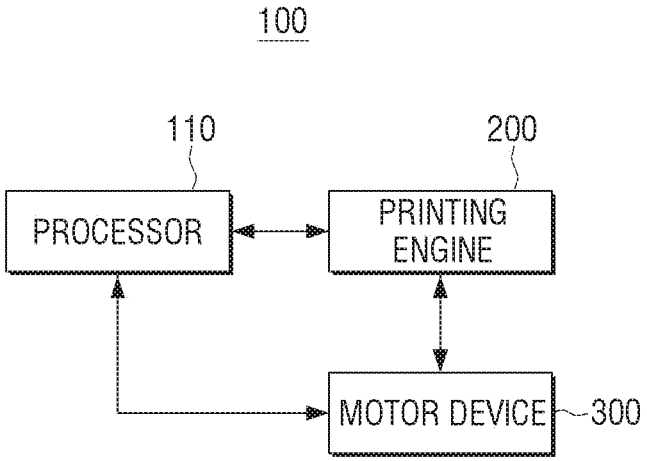
FIG. 1 is a block diagram illustrating a schematic configuration of an image forming apparatus according to an example.

FIG. 1 is a block diagram illustrating a schematic configuration of an image forming apparatus according to an example.

Referring to FIG. 1, an image forming apparatus 100 may include a printing engine 200, a motor device 300, and a processor 110.

The printing engine 200 may form an image. For example, the printing engine 200 may form a black-and-white image or a color image on a printing medium such as paper by using a plurality of photosensitive drums. In an example, a plurality of photosensitive drums may include a black photosensitive drum, a cyan photosensitive drum, a magenta photosensitive drum, and a yellow photosensitive drum.

The printing engine 200 may form a predetermined pattern for color registration on an image forming medium. In an example, a predetermined pattern may be a pattern that is capable of use for correcting a main scanning offset and a sub-scanning offset, a pattern for correcting only a main scanning offset, or a pattern for correcting only a sub-scanning offset. An image forming medium is a medium on which an image is formed, and in various examples may be an intermediate transcription belt, a transcription belt, etc.

The motor device 300 may operate the printing engine 200. For example, the motor device 300 may provide a driving force to each of a plurality of photosensitive drums. The motor device 300 may include a plurality of motors and an operating driver that provides driving signals to each of the plurality of motors. An example configuration and operation of the motor device 300 will be described later with reference to FIG. 3.

The processor 110 may operate each component in the image forming apparatus 100. In various examples, the processor 110 may include a single device such as a central processing unit (CPU), or a plurality of devices such as a clock generating circuit, a CPU, a graphic processor, etc.

When the processor 110 receives printing data from a terminal apparatus controlling printing (not shown), the processor 110 may generate a print image by performing rendering through an operation such as parsing of the received printing data.

The processor 110 may control the printing engine 200 such that the generated print image is printed. In an example, the processor 110 may control the motor device 300 such that at least one of a plurality of photosensitive drums may operate at a different speed from the other photosensitive drums while the printing data is printed. Here, photosensitive drums, which are subject to speed control, may be at least one of a cyan photosensitive drum, a magenta photosensitive drum, or a yellow photosensitive drum. In an example, a black photosensitive drum may be the aforementioned reference subject.

The processor 110 may control the printing engine 200 such that a predetermined pattern for color registration is formed. In an example, the processor 110 may control the printing engine 200 such that the aforementioned pattern for color registration is formed in a section wherein a printing job is not performed, or control the printing engine 200 such that the predetermined pattern is formed during a printing job (i.e., an interval between papers). Here, an interval between papers may refer to an interval between printing papers on a paper transfer route.

The processor 110 may calculate an offset value for each color by using a predetermined pattern. In an example, the processor 110 may calculate an offset value of each of different color patterns (i.e., a cyan photosensitive drum, a magenta photosensitive drum, and a yellow photosensitive drum) based on a black pattern (i.e., a black photosensitive drum). For example, the processor 110 may calculate an offset between a black photosensitive drum and a cyan photosensitive drum, an offset between a black photosensitive drum and a magenta photosensitive drum, and an offset between a black photosensitive drum and a yellow photosensitive drum.

The processor 110 may control a time point of exposure and a driving speed of a photosensitive drum according to the calculated offset value for each color. For example, with respect to an offset difference equal to or greater than a predetermined size (e.g., a line interval in a sub-scanning direction), the processor 110 may compensate an offset by adjusting a time point of exposure of a photosensitive drum (i.e., at least one of a cyan photosensitive drum, a magenta photosensitive drum, or a yellow photosensitive drum) based on offset information.

In an example, with respect to an offset difference smaller than a predetermined size, the processor 110 may compensate an offset by controlling a driving speed of a specific photosensitive drum (i.e., at least one of a cyan photosensitive drum, a magenta photosensitive drum, or a yellow photosensitive drum) based on offset information.

For example, the processor 110 may control the motor device 300 such that, if a transcription position of a cyan photosensitive drum is prior to a predetermined reference position, the cyan photosensitive drum operates slower than a reference speed of the cyan photosensitive drum. In an example, the processor 110 may control the motor device 300 such that, if a transcription position of a magenta photosensitive drum is behind a predetermined reference position, the magenta photosensitive drum operates faster than a reference speed of the magenta photosensitive drum.

In an example, a reference speed is the speed of the corresponding photosensitive drum in a case in which there is no offset, and the speed may have a value corresponding to a printing speed of the image forming apparatus 100.

Offset compensation as described above may be performed in a section wherein operation of a plurality of photosensitive drums has stopped (e.g., a section wherein a printing job was not performed), a non-exposure section wherein a plurality of photosensitive drums do not perform exposure during proceeding of a printing job, a non-transcription section wherein all of a plurality of photosensitive drums do not perform transcription during proceeding of a printing job, or a non-transcription section of an intermediate transcription belt. With respect to a time point of offset compensation, example descriptions will be made later with reference to FIGS. 8 to 11.

As described above, an image forming apparatus may correct a position difference equal to or smaller than one pixel, and thus a precise image can be output. Also, as color registration is performed in an interval between papers, no additional time for color registration is required.

In the above example, only simple components constituting an image forming apparatus are illustrated and described. However, in other examples, various components may be additionally included. A description of an example will be made below with reference to FIG. 2.

Figure 2:
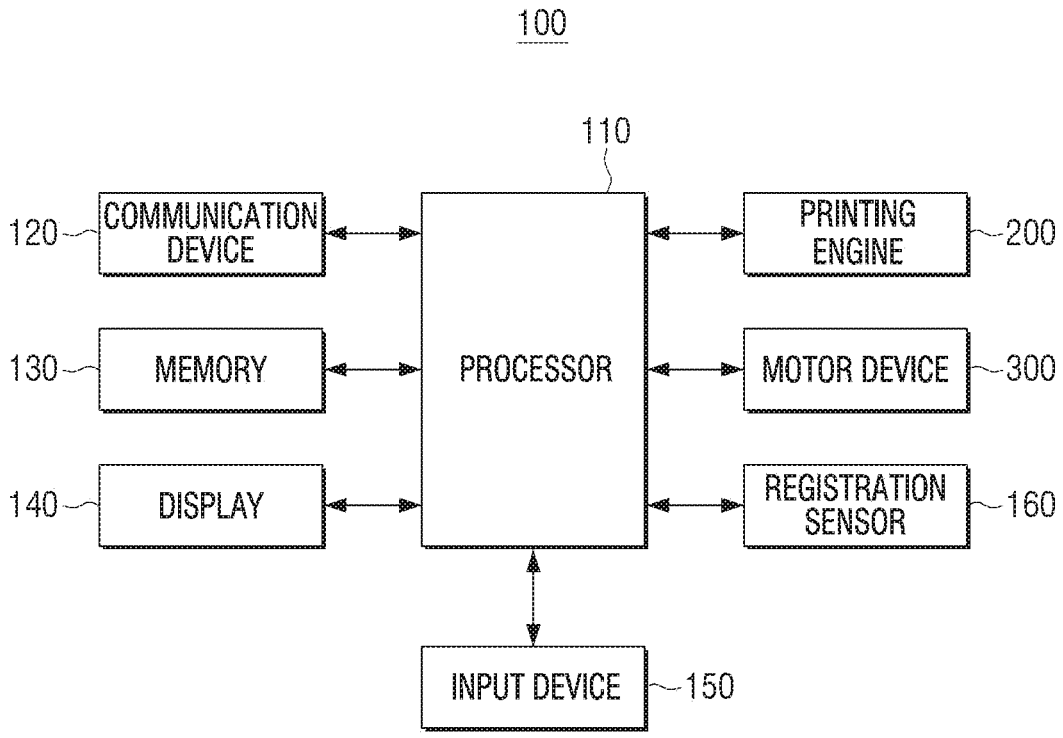
FIG. 2 is a block diagram illustrating a configuration of an image forming apparatus according to an example.

FIG. 2 is a block diagram illustrating a configuration of an image forming apparatus according to an example.

Referring to FIG. 2, an image forming apparatus 100 may include a printing engine 200, a motor device 300, a processor 110, a communication device 120, a memory 130, a display 140, an input device 150, and a registration sensor 160.

As the printing engine 200 and the motor device 300 were explained with reference to FIG. 1, an overlapping explanation will be omitted. Also, as the processor 110 was explained with reference to FIG. 1, contents explained with respect to FIG. 1 will not be repeatedly described, but only contents related to components added in FIG. 2 will be explained below.

The communication device 120 may be connected to a terminal apparatus controlling printing (not shown) and may receive printing data from the terminal apparatus. In an example, a terminal apparatus may include an electronic apparatus to provide printing data such as a personal computer (PC), a laptop computer, a tablet PC, a smartphone, a server, etc.

The communication device 120 may connect the image forming apparatus 100 with an external apparatus. Such a connection may be in the form of a local area network (LAN), an Internet network, etc. and may also be in the form of a universal serial bus (USB) port, a wireless communication (e.g., WiFi 802.11a/b/g/n, near field communication (NFC), Bluetooth) port, etc. Such a communication device 120 may also be referred to as a transceiver.

The memory 130 may store printing data. For example, the memory 130 may store printing data received from the communication device 120 and may store a rendering image for the received printing data. The memory 130 as described above may not only be implemented as a storage medium inside the image forming apparatus 100, but also as an external storage medium, a removable disk including a USB memory, a Web server through a network, etc.

In an example, the memory 130 may store a pattern image corresponding to a predetermined pattern. Further, the memory 130 may store a distance between papers corresponding to a printing speed.

The memory 130 may store information on a result of color registration (e.g., an offset value for each color), etc. and may store information on the speed of a motor for each offset (e.g., a driving frequency), etc. For example, the memory 130 may store information on a change value, a change ratio, etc. of a driving frequency for compensating a predetermined distance unit (e.g., 3 μm).

The display 140 may display various types of information provided by the image forming apparatus 100. For example, the display 140 may display a user interface window for receiving selection of various functions provided by the image forming apparatus 100.

The input device 150 may receive input of selection of a function and a control command for the function from a user. In an example, a function may include a printing function, a copying function, a scanning function, a fax transmission function, etc. A control command for a function as above may be input through a control menu displayed on the display 140.

The input device 150 as described above may be implemented as a plurality of buttons, a keyboard, a mouse, etc., or it may be implemented as a touch screen that is capable of performing the aforementioned functions of the display 140 simultaneously.

The registration sensor 160 may detect a formed pattern and may perform color registration based on the detected pattern. For example, the registration sensor 160 may detect a main scanning offset (an offset on an X axis) or a sub-scanning offset (an offset on a Y axis) between formed patterns.

The registration sensor 160 may include a light emitting part and a light receiving part. The light emitting part may emit light to an image forming medium at a regular level, and the light receiving part may detect light reflected from an intermediate transcription belt among the light emitted from the light emitting part and thereby recognize a predetermined pattern formed on the image forming medium.

When a predetermined pattern is formed, the processor 110 may control the registration sensor 160 such that the predetermined formed pattern is detected. The processor 110 may calculate an offset value for each color based on a recognition result at the registration sensor 160.

The processor 110 may store an offset value for each color in the memory 130 and perform a printing job by reflecting the offset value for each color during a printing process. In an example, the processor 110 may control a time point of exposure of each exposure device based on the generated offset value for each color and control a driving speed for each photosensitive drum based on the generated offset value for each color.

In illustrating and explaining an example of FIGS. 1 and 2, it was explained that the transcription positions of other photosensitive drums are relatively adjusted based on the transcription position of a black photosensitive drum. However, in other examples, it is possible that all of four photosensitive drums are controlled independently.

Figure 3:
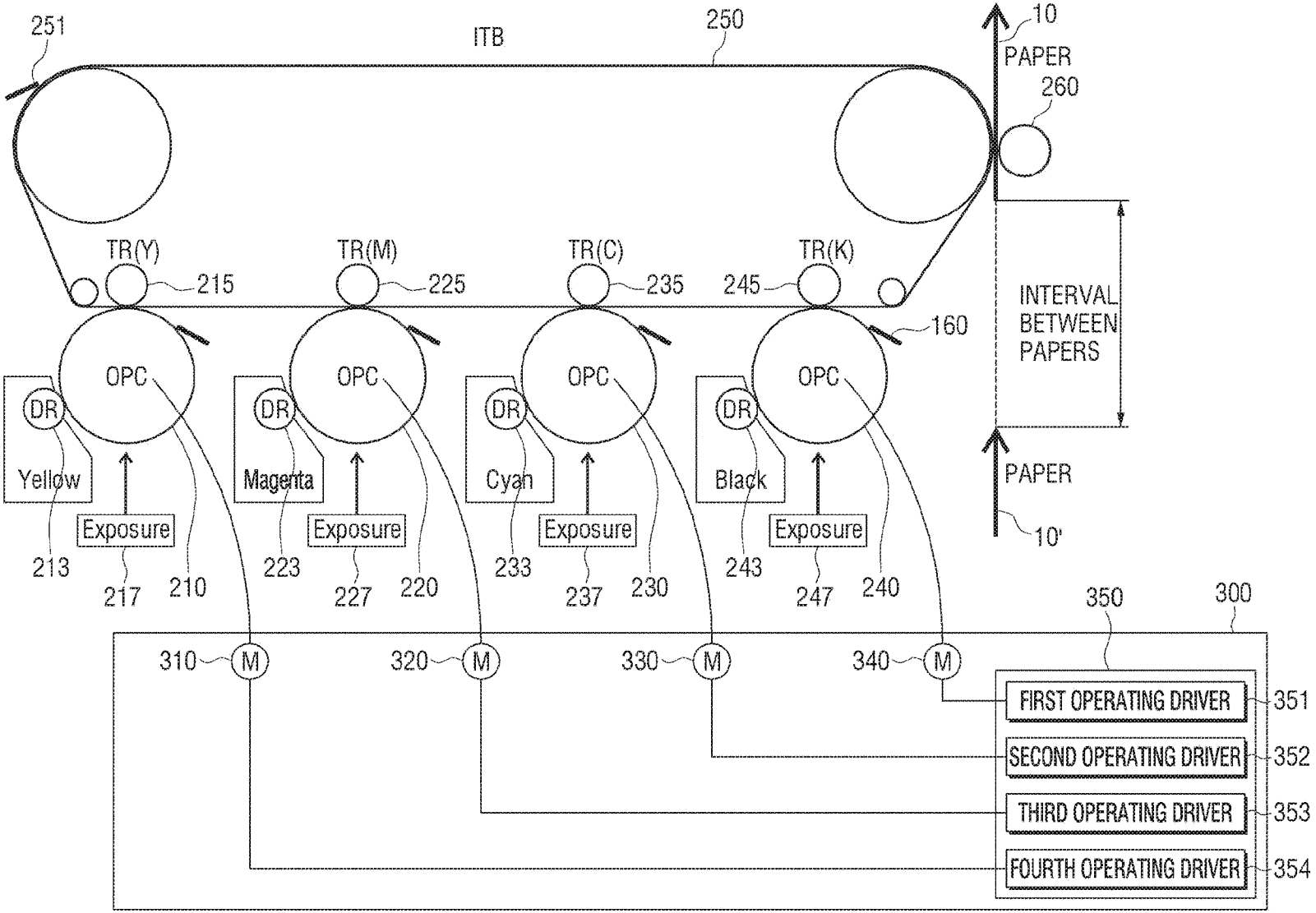
FIG. 3 is a diagram illustrating a printing engine according to an example.

FIG. 3 is a diagram illustrating a printing engine according to an example.

Referring to FIG. 3, the printing engine 200 may operate by a tandem method. In an example, a tandem method refers to a color printing method wherein a photosensitive drum for each color independently performs a job of forming an image for high speed printing.

On photosensitive drums 210, 220, 230, and 240, electrostatic latent images may be formed. The photosensitive drums 210, 220, 230, and 240 may each be referred to as an organic photoconductor (OPC), a photosensitive member, a photosensitive belt, etc. depending on their forms. In an example, the first photosensitive drum 210 may be a yellow photosensitive drum forming a yellow color, the second photosensitive drum 220 may be a magenta photosensitive drum forming a magenta color, the third photosensitive drum 230 may be a cyan photosensitive drum forming a cyan color, and the fourth photosensitive drum 240 may be a black photosensitive drum forming a black color.

A charger (not shown) may be provided to charge the surfaces of the photosensitive drums 210, 220, 230, and 240 with uniform electric potentials. The charger (not shown) may be implemented in the form of a corona charger, a charging roller, a charging brush, etc. and may be implemented as a plurality of chargers respectively corresponding to the plurality of photosensitive drums 210, 220, 230, and 240.

Exposure devices 217, 227, 237, and 247 may respectively form electrostatic latent images on the surfaces of the photosensitive drums 210, 220, 230, and 240 by changing the surface potentials of the photosensitive drums 210, 220, 230, and 240 according to information on an image to be printed. As an example, the exposure devices 217, 227, 237, and 247 may form electrostatic latent images by irradiating light modulated according to information on an image to be printed on the photosensitive drums 210, 220, 230, and 240. Such exposure devices 217, 227, 237, and 247 may operate according to a page synchronization signal and a parallel synchronization signal, and a time point of operation of the exposure devices 217, 227, 237, and 247 may be adjusted according to a main scanning offset value and a sub-scanning offset value calculated.

A developing device may accommodate a developing agent and may develop an electrostatic latent image into a visible image by supplying the developing agent to the electrostatic latent image. The developing device may include developing rollers 213, 223, 233, and 243 to respectively supply the developing agent to an electrostatic latent image. For example, the developing agent may be supplied from the developing rollers 213, 223, 233, and 243 to electrostatic latent images formed on the photosensitive drums 210, 220, 230, and 240 by a developing electric field formed between the developing rollers 213, 223, 233, and 243 and the photosensitive drums 210, 220, 230, and 240.

Visible images formed on the photosensitive drums 210, 220, 230, and 240 are transcribed to an intermediate transcription belt 250. For example, by transcription devices 215, 225, 235, and 245 for each color, images formed on each photosensitive drum 210, 220, 230, and 240 may be transcribed to the intermediate transcription belt 250. The images transcribed to the intermediate transcription belt 250 may be transcribed to a printing medium, such as paper, by a developing device 260.

By a fixing device (not shown), the images are fixed on the printing paper. A printing job may be completed by a series of processes as above.

As the aforementioned processes are performed in a unit of pages, a plurality of pages 10, 10' may be printed.

In an example process of printing a plurality of pages, an interval between printing papers (e.g., 10, 10') on a paper transfer route is referred to as an interval between papers. Also, a space in an area of an intermediate transcription belt corresponding to such an interval between papers will hereinafter be referred to as an interval section between papers.

In an example, a predetermined pattern for color registration is formed in such an interval section between papers. A pattern formed on an intermediate transcription belt is not transcribed to a printing paper. Thus, the pattern may be cleaned by using a cleaning member 251 disposed on one side of the intermediate transcription belt 250.

The motor device 300 may include a plurality of motors 310, 320, 330, and 340 and an operating driver 350.

Each of the plurality of motors 310, 320, 330, and 340 may provide a driving force to a corresponding photosensitive drum. In an example, the motors 310, 320, 330, and 340 are provided inside the image forming apparatus 100, and they may be a DC motor, a step motor, a brushless DC (BLDC) motor, etc. In the example of FIG. 3, it was illustrated that motors operate only photosensitive drums. However, in other examples, motors may operate other developing rollers, transcription rollers, fixing devices, etc. as well as photosensitive drums.

In an example, the fourth motor 340 providing a driving force to the fourth photosensitive drum may also operate the intermediate transcription belt 250 together.

In an example, the operating driver 350 may generate operating signals for each of the motors 310, 320, 330, and 340 according to an operation command of the processor 110. For this, the operating driver 350 may include a plurality of operating drivers 351, 352, 353, and 354 for controlling each of the plurality of motors.

In an example, each of the plurality of operating drivers 351, 352, 353, and 354 may provide a predetermined power source to a corresponding motor 310, 320, 330, and 340. For example, in a case in which the motor is a step motor, the operating driver 350 may receive an operation command (e.g., information on the size of the current and information on the speed), provide a constant current to the step motor in response to the received information on the size of the current, and provide an impulse driving signal corresponding to the information on the speed to the step motor.

In a case in which the motor is a BLDC motor, each of the plurality of operating drivers 351, 352, 353, and 354 may receive information on the speed, provide a predetermined constant voltage to the BLDC motor, and provide a driving signal corresponding to the received information on the speed to the BLDC motor. In an example, information on the speed may be a driving frequency reflecting a value for compensating a color offset as described earlier.

In an example, a limitation in a case of adjusting only a time point of irradiation of an exposure device will be described with reference to FIG. 4, and an example operation according to the disclosure will be described with reference to FIG. 5.

Figure 4:
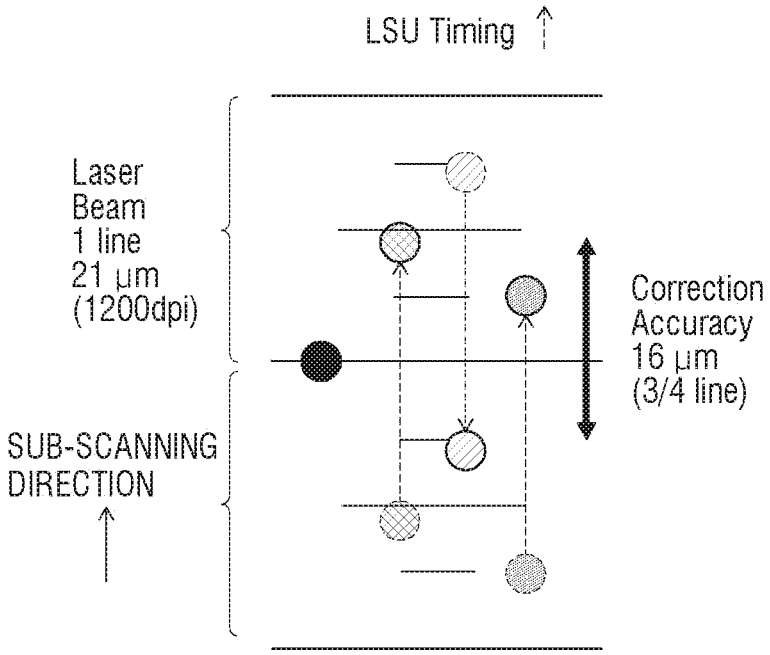
FIG. 4 is a diagram illustrating an error in a transcription position in a case of adjusting only a time point of irradiation of an exposure device according to an example.

FIG. 4 is a diagram illustrating an error in a transcription position in a case of adjusting only a time point of irradiation of an exposure device according to an example.

Referring to FIG. 4, transcription positions of other photosensitive drums are indicated based on a black photosensitive drum. For example, each exposure device may be adjusted in a unit of time corresponding to the distance of 1 line (i.e., 1 scanning line segment). For example, in a case in which a position difference exceeding a distance of an interval of a ½ line occurred in a sub-scanning direction, the difference may be compensated such that there is only an error equal to or smaller than a distance of an interval of a ½ line through an operation of pulling or pushing 1 line.

In an example, for each of cyan, magenta, and yellow photosensitive drums, compensation of an error may be performed based on a transcription position of a black photosensitive drum. Thus, among cyan, magenta, and yellow photosensitive drums, there may be an error corresponding to a distance of an interval of approximately 1 line.

For example, in an image forming apparatus having a resolution of 1200 dpi, 1 line has a 21 μm pitch, and accordingly, between two photosensitive drums, there may be an error of 16 μm at the maximum.

As can be seen in the above described example, by only adjusting a time point of irradiation of an exposure device, there may be a difficulty in compensating an overlapping difference corresponding to a distance of equal to or smaller than an interval of 1 line.

To address this difficulty, for compensating an overlapping difference of equal to or smaller than an interval of 1 line, compensation may be performed by using a time point of irradiation of an exposure device for an overlapping difference of equal to or greater than an interval of 1 line as described above, but for an overlapping difference of smaller than an interval of 1 line, the overlapping difference may be compensated by adjusting the driving speed of a motor.

Hereinafter, an example of compensating a transcription position by varying a speed of a motor will be explained.

Figure 5:
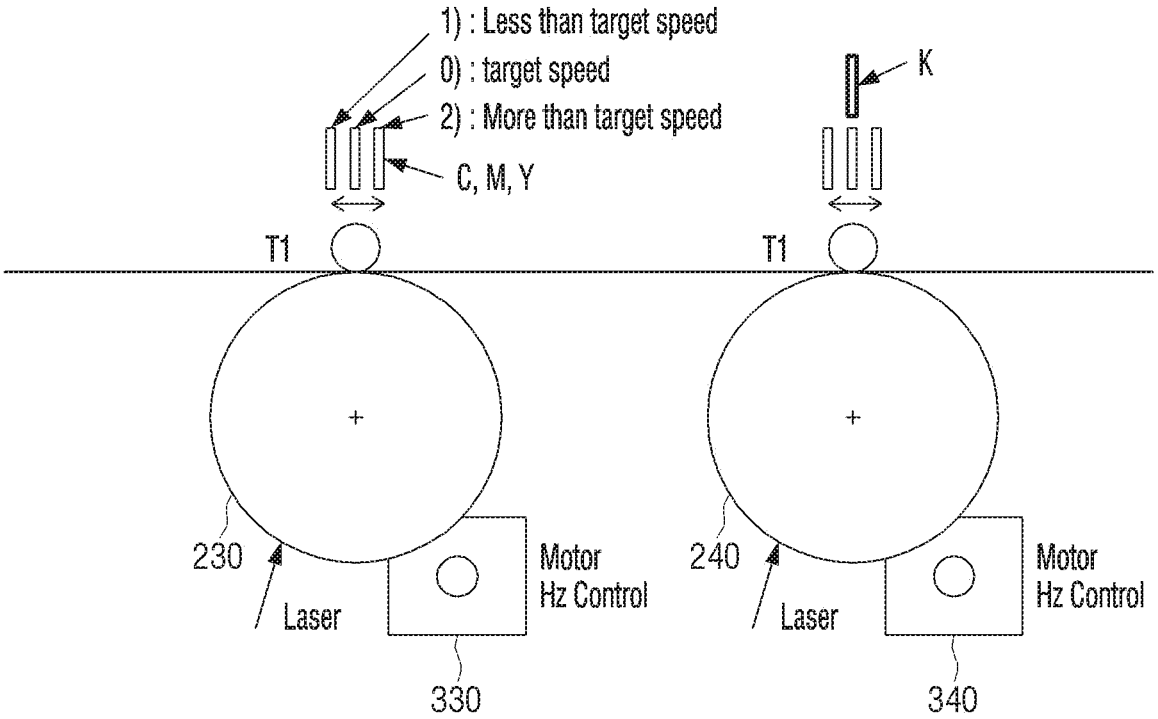
FIG. 5 is a diagram illustrating a transcription position according to adjustment of a motor speed according to an example.

FIG. 5 is a diagram illustrating a transcription position according to adjustment of a motor speed according to an example.

Referring to FIG. 5, a time for moving from a position at which a laser is irradiated to a transcription position T1 of an intermediate transcription belt is determined by a rotation speed of a photosensitive drum.

For example, if a driving frequency is made to be lower than a reference speed (0), a time for reaching a transcription position from a position at which the laser is irradiated becomes longer, and thus a transcription position on an intermediate transcription belt is more delayed than a target position. In contrast, if a driving frequency is made to be higher than a reference speed (0), a time for reaching a transcription position from a position at which the laser is irradiated becomes shorter, and thus a transcription position on an intermediate transcription belt is prior to a target position.

In an example, if a transcription position of the third photosensitive drum 230 is delayed based on the fourth photosensitive drum 240, the processor 110 may make the driving frequency of the motor 330 driving the third photosensitive drum 230 higher, and thereby make the transcription position of the third photosensitive drum 230 prior to the fourth photosensitive drum 240.

In contrast, if the transcription position of the third photosensitive drum 230 is prior based on the fourth photosensitive drum 240, the processor 110 may make the driving frequency of the motor 330 driving the third photosensitive drum 230 lower, and thereby make the transcription position of the third photosensitive drum 230 delayed to the fourth photosensitive drum 240.

Even if a driving frequency of a photosensitive drum varies and a time for reaching a transcription position from a position wherein the laser is irradiated becomes longer or shorter, a time point of initiating exposure is identical to the past. That is, in a process of forming a line, only a time interval from a position wherein the laser is irradiated to a transcription position is adjusted, but a time interval between a line and a line is not adjusted.

Figure 6:
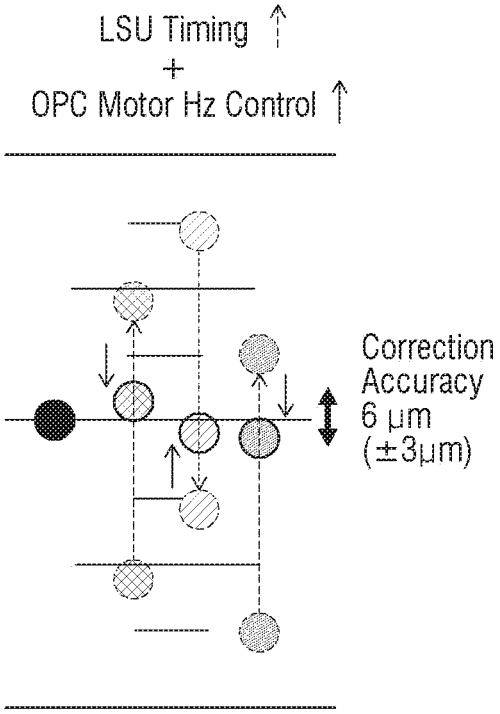
FIG. 6 is a diagram illustrating an error in a transcription position in a case of adjusting a time point of irradiation of an exposure device and a driving speed of a motor according to an example.

FIG. 6 is a diagram illustrating an error in a transcription position in a case of adjusting a time point of irradiation of an exposure device and a driving speed of a motor according to an example.

Referring to FIG. 6, an operating frequency of a motor is adjusted along with controlling of timing of irradiation of a laser. Thus, an overlapping difference between photosensitive drums can be corrected more precisely. For example, an error correction of 16 μm at the maximum can be reduced to an error correction of 6 μm at the maximum.

The aforementioned range of an error is merely an example, and the aforementioned maximum error can be further reduced in a case in which the speed of a motor can be controlled more precisely.

Figure 7:
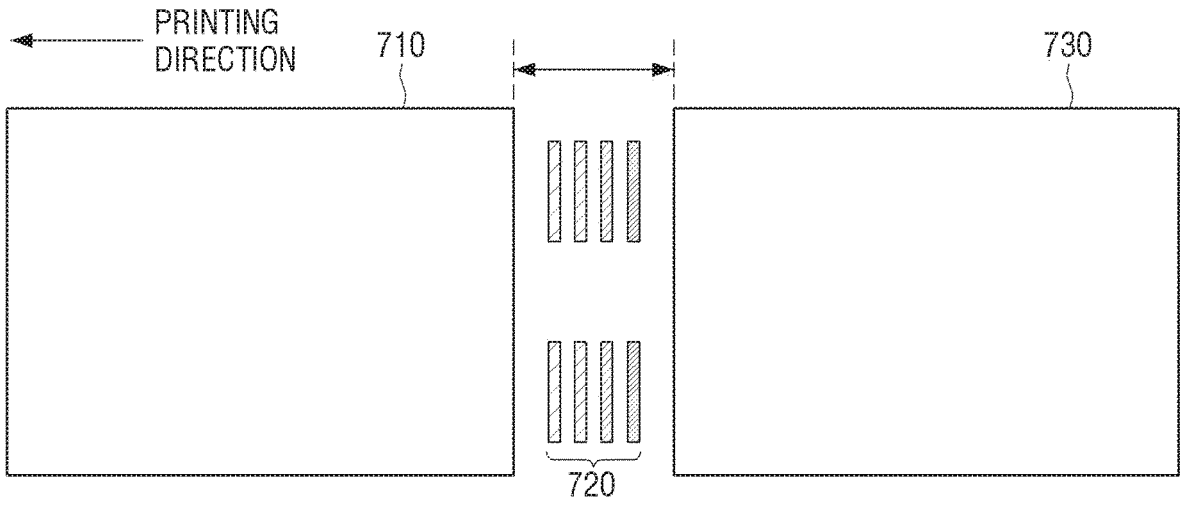
FIG. 7 is a diagram illustrating a pattern formed according to an example.

FIG. 7 is a diagram for illustrating a pattern formed according to an example.

Referring to FIG. 7, an interval between papers may be disposed between a first page 710 and a second page 730. In an example, a predetermined pattern 720 may be formed in an interval section between papers of an area of an intermediate transcription belt corresponding to the interval between papers.

The predetermined pattern 720 may include a plurality of patches disposed at predetermined intervals. Each of the plurality of patches may be in the form of a bar and have a different color from the other patches.

In the example of FIG. 7, four patches are illustrated. However, this is only an example. In other examples, five or more patches may be included. Also, although it was described that separate patch sets are disposed in each of the two areas, patch sets may be disposed in three or more areas in a main scanning direction. In an example, a main scanning direction is a direction perpendicular to the moving direction of a printing paper (or an exposure direction of an exposure device), and a sub-scanning direction is the moving direction of a printing paper.

In an example, when a predetermined pattern is formed on the intermediate transcription belt 250 by the printing engine 200 as described above, the pattern on the intermediate transcription belt 250 moves to the lower part of the registration sensor 160 by rotation.

Accordingly, in a case in which a predetermined pattern moves below the registration sensor 160, the processor 110 may calculate an offset for each color.

Figure 8:
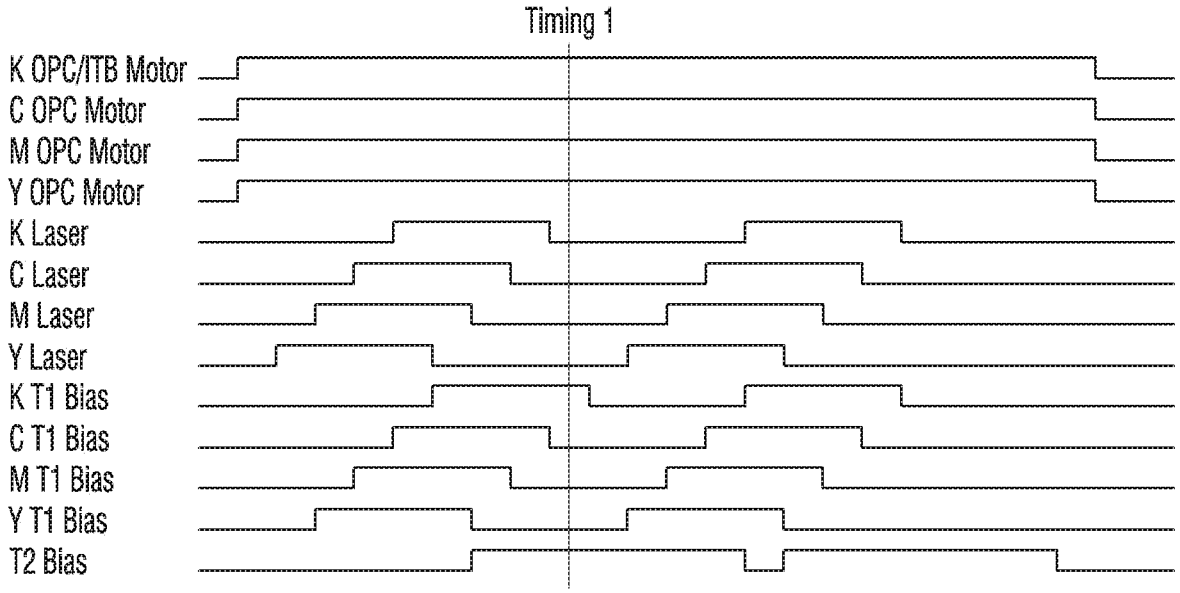
FIG. 8 is a diagram illustrating an example of a time point of adjustment of a motor speed according to an example.

FIG. 8 is a diagram illustrating a time point of adjustment of a motor speed according to an example.

Referring to FIG. 8, in a case in which a printing job is being performed, a first motor (Y OPC Motor) for driving a first photosensitive drum (Y OPC) is being operated, a second motor (M OPC Motor) for driving a second photosensitive drum (M OPC) is being operated, a third motor (C OPC Motor) for driving a third photosensitive drum (C OPC) is being operated, and a fourth motor (K OPC/ITB Motor) for driving a fourth photosensitive drum (K OPC) and an intermediate transcription belt (ITB) is being operated.

While the motors are being operated, exposure devices (e.g., Y Laser, M Laser, C Laser, and K Laser) corresponding to the first to fourth photosensitive drums sequentially perform exposure.

If exposure devices perform exposure operations as above, a toner is attached to a position at which a laser was irradiated, and at time points when the toner of each photosensitive medium is transcribed to an intermediate transcription belt, bias voltages are sequentially applied.

In a first example, at a time point when all of a plurality of photosensitive media do not irradiate a laser (i.e., a non-exposure section), driving frequencies for the first motor (Y OPC Motor), the second motor (M OPC Motor), and the third motor (C OPC Motor) are changed.

Figure 9:
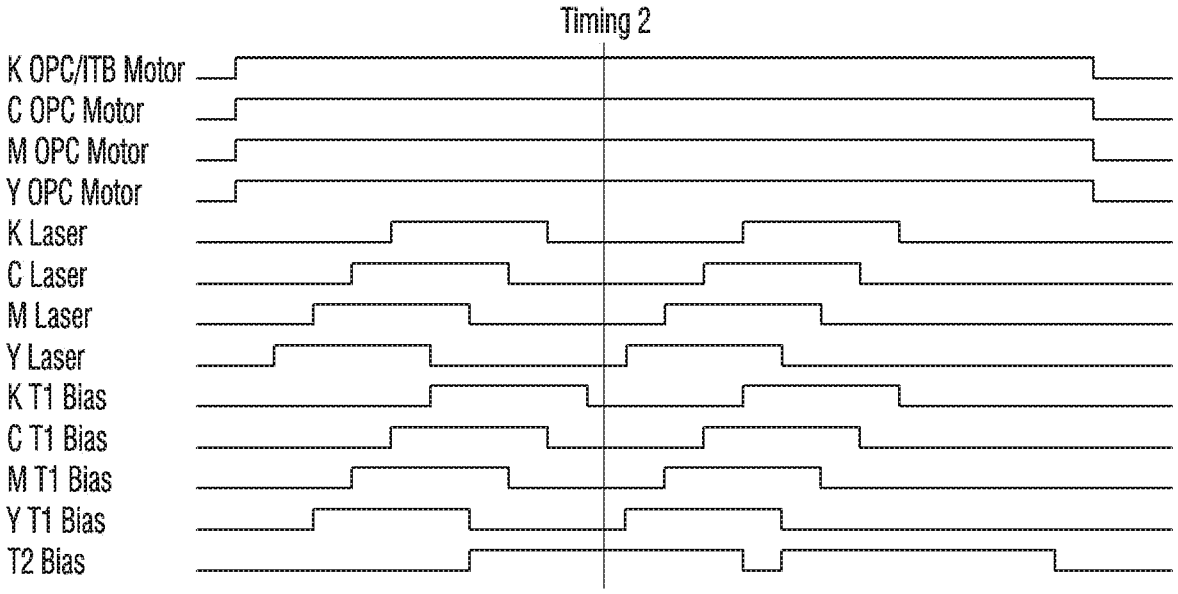
FIG. 9 is a diagram illustrating a time point of adjustment of a motor speed according to an example.

FIG. 9 is a diagram illustrating a time point of adjustment of a motor speed according to an example.

Referring to FIG. 9, in an example, at a time point when each of a plurality of photosensitive media do not perform a transcription operation on an intermediate transcription belt (i.e., a non-transcription section), driving frequencies for the first motor (Y OPC Motor), the second motor (M OPC Motor), and the third motor (C OPC Motor) are changed.

Figure 10:
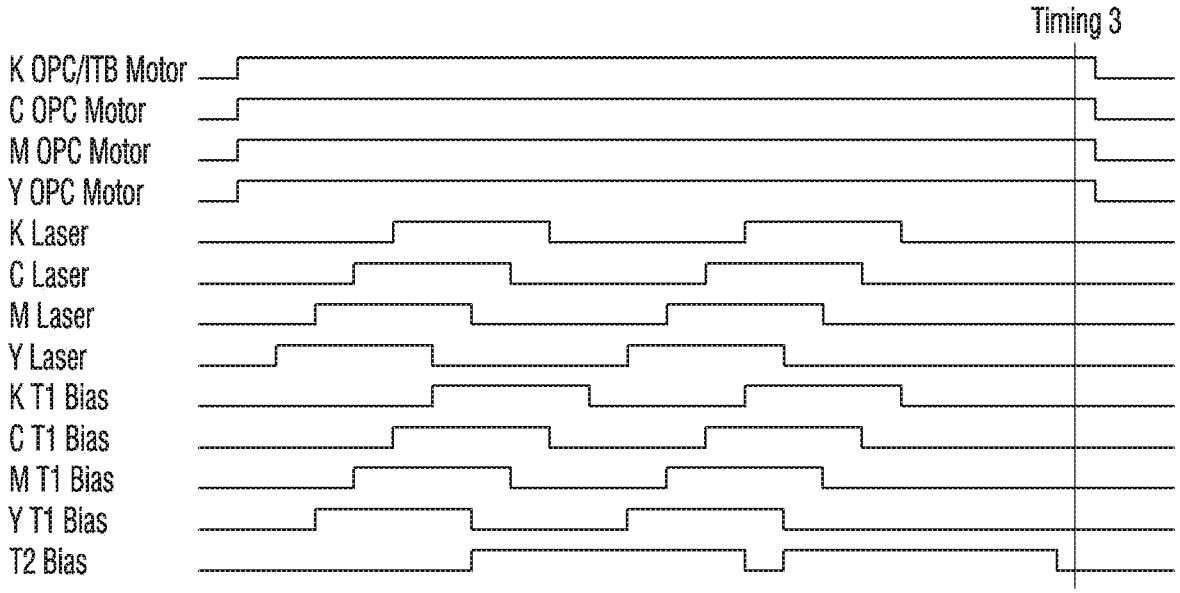
FIG. 10 is a diagram illustrating a time point of adjustment of a motor speed according to an example.

FIG. 10 is a diagram illustrating a time point of adjustment of a motor speed according to an example.

Referring to FIG. 10, in an example, at a time point when transcription of an image from an intermediate transcription belt to a paper is completed (i.e., a non-transcription section of an intermediate transcription belt), driving frequencies for the first motor (Y OPC Motor), the second motor (M OPC Motor), and the third motor (C OPC Motor) are changed.

Figure 11:
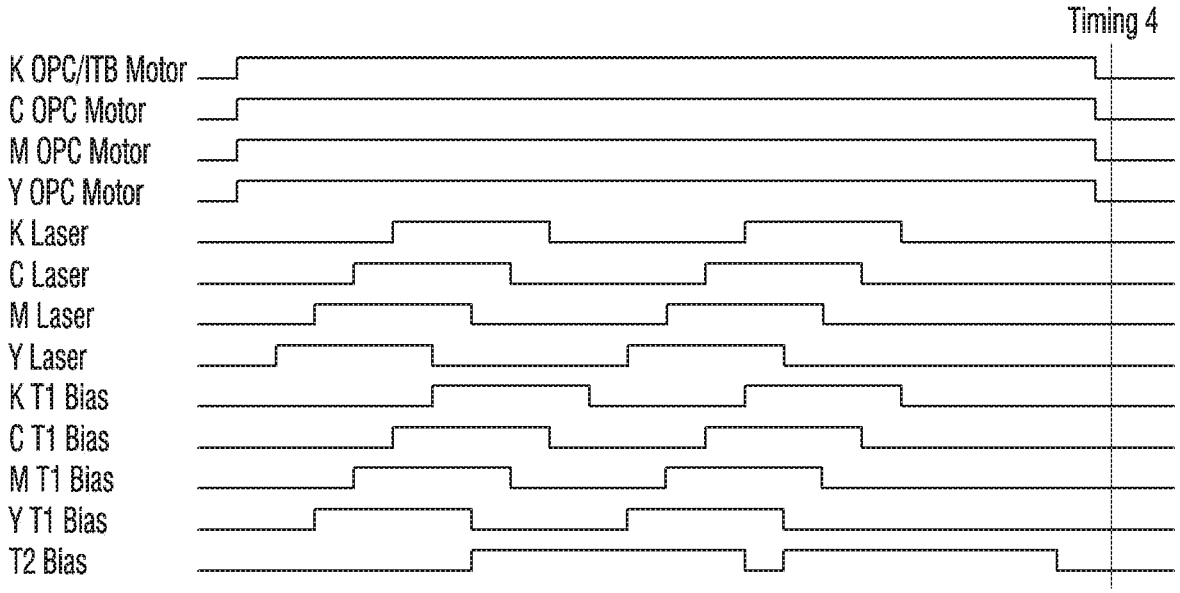
FIG. 11 is a diagram illustrating a time point of adjustment of a motor speed according to an example.

FIG. 11 is a diagram illustrating a time point of adjustment of a motor speed according to an example.

Referring to FIG. 11, in an example, at a time point when operation of a plurality of photosensitive drums has stopped (or operation of a plurality of motors has stopped), driving frequencies for the first motor (Y OPC Motor), the second motor (M OPC Motor), and the third motor (C OPC Motor) are changed.

Figure 12:
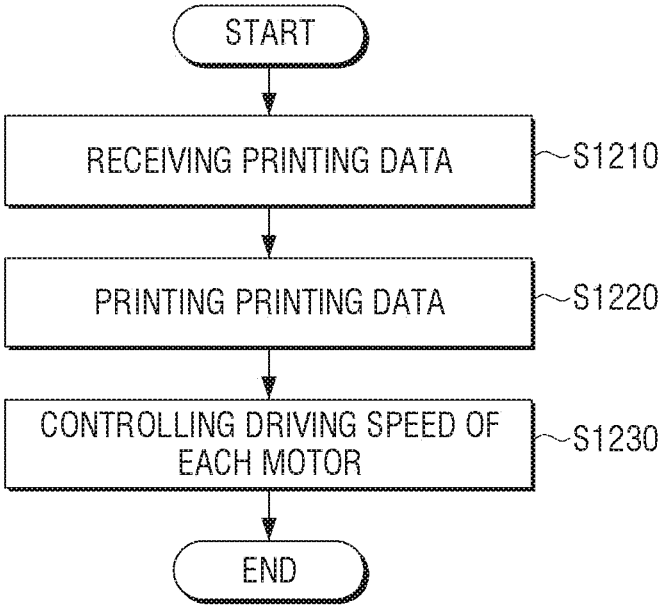
FIG. 12 is a flowchart illustrating a method of color registration according to an example.

FIG. 12 is a flowchart for illustrating a method of color registration according to an example.

Referring to FIG. 12, printing data is received at operation S1210. For example, when printing data is received, a print image may be generated through parsing and rendering, etc. for the received printing data.

The received printing data is printed by using a plurality of photosensitive drums at operation S1220. In an example, with respect to an offset difference equal to or greater than a predetermined size, the received printing data may be printed by adjusting a time point of exposure of at least one photosensitive drum based on position offset information for each color.

The motor device 300 providing a driving force to each of a plurality of photosensitive drums is controlled such that at least one of the plurality of photosensitive drums may operate at a different speed from the other photosensitive drums while the printing data is printed at operation S1230. For example, with respect to an offset difference equal to or greater than a predetermined size, the received printing data may be printed by adjusting a time point of exposure of at least one photosensitive drum based on position offset information for each color. With respect to an offset difference smaller than a predetermined size, the driving speed for at least one photosensitive drum may be controlled.

For example, if the transcription position of at least one photosensitive drum is prior to a predetermined reference position, the at least one photosensitive drum may be operated slower than a reference speed of the at least one photosensitive drum, and if the transcription position is behind a predetermined reference position, the at least one photosensitive drum may be operated faster than the reference speed.

As described above, an example color registration method may correct a position difference equal to or smaller than one pixel, and thus a precise color image can be output. Also, as color registration may be performed in an interval section between papers, no additional time for color registration is required.

The example color registration method may be provided to an image forming apparatus. For example, a program including a color registration method may be provided while being stored in a non-transitory computer readable medium. In an example, a non-transitory computer readable medium may be a compact disc (CD), a digital video disc (DVD), a hard disc drive (HDD), a solid-state drive (SSD), a blue-ray disc, a USB, a memory card, a read-only memory (ROM), etc.

While examples of the disclosure have been shown and described, the disclosure is not limited to the aforementioned examples, and it is apparent that various modifications can be made by those having ordinary skill in the art to which the disclosure belongs, without departing from the gist of the disclosure as claimed by the appended claims, and such modifications are within the scope of the descriptions of the claims.

What is claimed is:

1. An image forming apparatus comprising:

a printing engine including a plurality of photosensitive drums;

a motor device to provide a driving force to each of the plurality of photosensitive drums; and a processor to:

control the printing engine such that printing data is printed on a printing paper, control the motor device such that at least one of the plurality of photosensitive drums operates at a different speed from the other photosensitive drums while the printing data is printed, and control the motor device, based on a transcription position of the at least one photosensitive drum being prior to a predetermined reference position, such that the at least one photosensitive drum operates slower than a reference speed of the at least one photosensitive drum or control the motor device, based on the transcription position being behind the predetermined reference position, such that the at least one photosensitive drum operates faster than the reference speed.

2. The image forming apparatus of claim 1, further comprising:

a memory to store position offset information for each color, wherein the processor is to:

adjust, based on the offset information, a time point of exposure for the at least one photosensitive drum with respect to an offset difference equal to or greater than a predetermined size and compensate an offset, and control a driving speed for the at least one photosensitive drum with respect to an offset difference smaller than the predetermined size and compensate an offset for the at least one photosensitive drum.

3. The image forming apparatus of claim 2, wherein the predetermined size includes a line interval in a sub-scanning direction.

4. The image forming apparatus of claim 1, wherein the processor is to control the printing engine such that a predetermined pattern for color registration is formed within an interval section between printing papers on a paper transfer route, wherein the image forming apparatus includes a registration sensor recognizing the formed predetermined pattern, and wherein the processor is to calculate an offset value for each color based on a recognition result at the registration sensor.

5. The image forming apparatus of claim 4, wherein the processor is to calculate an offset value for each color with respect to each of a cyan photosensitive drum, a magenta photosensitive drum, and a yellow photosensitive drum, based on a black photosensitive drum.

6. The image forming apparatus of claim 4, wherein the processor is to set a motor speed value corresponding to the calculated offset value in at least one section among a non-exposure section of all of the plurality of photosensitive drums, a non-transcription section of all of the plurality of photosensitive drums, or a non-transcription section of an intermediate transcription belt.

7. The image forming apparatus of claim 4, wherein the processor is to set a motor speed value corresponding to the calculated offset value in a section wherein an operation of the plurality of photosensitive drums has stopped.

8. The image forming apparatus of claim 1, wherein the other photosensitive drum includes a black photosensitive drum, and wherein the at least one photosensitive drum is one of a cyan photosensitive drum, a magenta photosensitive drum, or a yellow photosensitive drum.

9. A method of color registration in an image forming apparatus, the method of color registration comprising:

receiving printing data;

printing the received printing data by using a plurality of photosensitive drums;

controlling a motor device to provide a driving force to each of the plurality of photosensitive drums such that at least one of the plurality of photosensitive drums operates at a different speed from the other photosensitive drums while the printing data is printed; and based on a transcription position of the at least one photosensitive drum being prior to a predetermined reference position, driving the at least one photosensitive drum slower than a reference speed of the at least one photosensitive drum or, based on the transcription position being behind the predetermined reference position, driving the at least one photosensitive drum faster than the reference speed.

10. The method of color registration of claim 9, wherein the printing comprises adjusting, based on position offset information for each color, a time point of exposure for the at least one photosensitive drum with respect to an offset difference equal to or greater than a predetermined size and printing the received printing data, and wherein the controlling of the motor device comprises controlling a driving speed for the at least one photosensitive drum with respect to an offset difference smaller than the predetermined size.

11. The method of color registration of claim 10, wherein the predetermined size includes a line interval in a sub-scanning direction.

12. The method of color registration of claim 10, wherein the printing comprises forming a predetermined pattern for color registration within an interval section between printing papers on a paper transfer route, and wherein the method of color registration further comprises:

recognizing the formed predetermined pattern; and calculating an offset value for each color based on a recognition result at a registration sensor.

13. The method of color registration of claim 12, wherein the controlling of the motor device comprises:

setting a motor speed value corresponding to the calculated offset value in at least one section among a non-exposure section of all of the plurality of photosensitive drums, a non-transcription section of all of the plurality of photosensitive drums, or a non-transcription section of an intermediate transcription belt.

14. An image forming apparatus comprising:

a printing engine including a plurality of photosensitive drums;

a memory to store position offset information for each color, a motor device to provide a driving force to each of the plurality of photosensitive drums; and a processor to:

control the printing engine such that printing data is printed on a printing paper, control the motor device such that at least one of the plurality of photosensitive drums operates at a different speed from the other photosensitive drums while the printing data is printed, adjust, based on the offset information, a time point of exposure for the at least one photosensitive drum with respect to an offset difference equal to or greater than a predetermined size and compensate an offset, and control a driving speed for the at least one photosensitive drum with respect to an offset difference smaller than the predetermined size and compensate an offset for the at least one photosensitive drum.

15. The image forming apparatus of claim 14, wherein the processor is to:

control the motor device, based on a transcription position of the at least one photosensitive drum being prior to a predetermined reference position, such that the at least one photosensitive drum operates slower than a reference speed of the at least one photosensitive drum, or control the motor device, based on the transcription position being behind the predetermined reference position, such that the at least one photosensitive drum operates faster than the reference speed.

16. The image forming apparatus of claim 14, wherein the predetermined size includes a line interval in a sub-scanning direction.

17. The image forming apparatus of claim 14, wherein the processor is to control the printing engine such that a predetermined pattern for color registration is formed within an interval section between printing papers on a paper transfer route, wherein the image forming apparatus includes a registration sensor recognizing the formed predetermined pattern, and wherein the processor is to calculate an offset value for each color based on a recognition result at the registration sensor.

18. The image forming apparatus of claim 17, wherein the processor is to calculate an offset value for each color with respect to each of a cyan photosensitive drum, a magenta photosensitive drum, and a yellow photosensitive drum, based on a black photosensitive drum.

19. The image forming apparatus of claim 17, wherein the processor is to set a motor speed value corresponding to the calculated offset value in at least one section among a non-exposure section of all of the plurality of photosensitive drums, a non-transcription section of all of the plurality of photosensitive drums, a non-transcription section of an intermediate transcription belt, or a section wherein an operation of the plurality of photosensitive drums has stopped.

20. The image forming apparatus of claim 14, wherein the other photosensitive drum includes a black photosensitive drum, and wherein the at least one photosensitive drum is one of a cyan photosensitive drum, a magenta photosensitive drum, or a yellow photosensitive drum.

* * * * *